US010970994B2

(12) United States Patent
Norton et al.

(10) Patent No.: US 10,970,994 B2
(45) Date of Patent: Apr. 6, 2021

(54) METHOD AND SYSTEM FOR MONITORING FIRE ALARM SYSTEMS

(71) Applicant: Tyco Fire & Security GmbH, Neuhausen am Rheinfall (CH)

(72) Inventors: Alexandra K. Norton, Duxbury, MA (US); Joseph Piccolo, III, Fitzwilliam, NH (US); Craig Trivelpiece, Mission Viejo, CA (US)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 15/957,543

(22) Filed: Apr. 19, 2018

(65) Prior Publication Data

US 2018/0240326 A1 Aug. 23, 2018

Related U.S. Application Data

(62) Division of application No. 15/342,427, filed on Nov. 3, 2016, now Pat. No. 9,978,256.

(51) Int. Cl.

| | |
|---|---|
| ***G08B 29/04*** | (2006.01) |
| ***G08B 25/08*** | (2006.01) |
| ***G08B 25/10*** | (2006.01) |
| ***G08B 29/12*** | (2006.01) |
| ***G08B 29/14*** | (2006.01) |
| ***G08B 25/14*** | (2006.01) |
| *G08B 17/10* | (2006.01) |

(52) U.S. Cl.

CPC ..... *G08B 29/043* (2013.01); *G08B 25/08* (2013.01); *G08B 25/10* (2013.01); *G08B 25/14* (2013.01); *G08B 29/046* (2013.01); *G08B 29/126* (2013.01); *G08B 29/145* (2013.01); *G08B 17/10* (2013.01)

(58) Field of Classification Search

CPC ..... G08B 29/043; G08B 25/08; G08B 25/10; G08B 25/14; G08B 29/046; G08B 29/126; G08B 29/145; G08B 17/10

USPC ..... 340/506

See application file for complete search history.

(56) References Cited

U.S. PATENT DOCUMENTS

| | | | | |
|---|---|---|---|---|
| 8,779,919 | B1 * | 7/2014 | Darling | H04W 4/90 340/539.16 |
| 8,836,467 | B1 | 9/2014 | Cohn et al. | |
| 2010/0127865 | A1 | 5/2010 | Marriam et al. | |

(Continued)

FOREIGN PATENT DOCUMENTS

| | | | |
|---|---|---|---|
| EP | 184497 | A2 | 10/2007 |
| WO | 2010/120771 | A1 | 10/2010 |
| WO | 2016/022662 | A1 | 2/2016 |

OTHER PUBLICATIONS

International Preliminary Report on Patentability of the International Searching Authority, dated May 16, 2019, from International Application No. PCT/IB2017/056828, filed on Nov. 2, 2017. 8 pages.

*Primary Examiner* — Jack K Wang

(74) *Attorney, Agent, or Firm* — HoustonHogle LLP

(57) ABSTRACT

The near-universal connection between control panels and monitoring stations is used to transmit status information for non-compatible control panels to connected services systems. In this way, connected services systems can incorporate monitoring and tracking of non-compatible control panels as well as compatible control panels.

20 Claims, 4 Drawing Sheets

(56) References Cited

U.S. PATENT DOCUMENTS

| | | | | |
|---|---|---|---|---|
| 2010/0280635 | A1* | 11/2010 | Cohn | H04L 69/26 700/90 |
| 2012/0188067 | A1 | 7/2012 | Xiao | |
| 2015/0206421 | A1 | 7/2015 | Moffa | |
| 2015/0248832 | A1* | 9/2015 | Piccolo, III | G08B 29/145 340/514 |
| 2015/0348399 | A1* | 12/2015 | Cree | G06F 3/0488 340/514 |
| 2017/0070563 | A1 | 3/2017 | Sundermeyer et al. | |
| 2018/0197387 | A1* | 7/2018 | Dawes | H04W 12/0806 |

* cited by examiner

METHOD AND SYSTEM FOR MONITORING FIRE ALARM SYSTEMS

RELATED APPLICATIONS

This application is a Divisional of U.S. patent application Ser. No. 15/342,427, filed on Nov. 3, 2016, which is incorporated herein by reference in its entirety.

BACKGROUND OF THE INVENTION

Fire alarm systems are often installed within buildings such as commercial, residential, or governmental buildings. Examples of these buildings include offices, hospitals, warehouses, schools, shopping malls, government offices, and casinos.

The fire alarm systems typically include fire control panels (or control panels) that function as system controllers. Fire detection/initiation devices and alarm notification devices are then installed throughout the buildings and connected to the panels. Some examples of fire detection/initiation devices include smoke detectors, carbon monoxide detectors, flame detectors, temperature sensors, and/or pull stations (also known as manual call points). Some examples of fire notification devices include speakers, horns, bells, chimes, light emitting diode (LED) reader boards, and/or flashing lights (e.g., strobes).

The fire detection devices monitor the buildings for indicators of fire. Upon detection of an indicator of fire such as smoke or heat or flames, the device is activated and a signal is sent from the activated device to the control panel. The control panel then initiates an alarm condition by activating audio and visible alarms of the fire notification devices of the fire alarm system. Additionally, the control panel will also send an alarm signal to a monitoring station, which will notify the local fire department or fire brigade.

The monitoring stations will typically monitor multiple fire alarm systems for alarm signals and then notify the proper authorities. Monitoring stations are often required by regulations, making them a standard component of most fire alarm systems, regardless of age or manufacturer of the fire alarm systems' components. These monitoring stations can be administered by a third party company, the same company that provides or manufactures the fire alarm systems, or a public agency, among examples.

The monitoring stations will receive other signals, beyond the alarm signals, from the fire alarm systems. Handshaking signals between the control panels and the monitoring stations are used to confirm the connection status between the fire alarm systems and the monitoring station. Typically, monitoring stations include computer and software systems for receiving, storing, analyzing and displaying connectivity status and fire alarm information based on the signals received from the fire alarm systems. A technician monitors the information and, in the event of a potential fire, informs the local fire department or fire brigade and/or initiates a specified sequence of actions in response to receiving alarm signals for a potential fire.

Typically, building codes, local laws, standards, and/or insurance providers require that the fire alarm systems are periodically tested (e.g., monthly, quarterly, or annually) to verify that the fire detection/initiation and fire notification devices are physically sound, unaltered, working properly, and located in their assigned locations. This testing of the devices is often accomplished with a walkthrough test.

Historically, walkthrough tests were performed by a team of at least two technicians, also known as inspectors. The first technician walked through the building and manually activated each fire detection/initiation such as will artificial smoke while the second technician remained at the control panel to verify that the control panel received a signal from the activated device and/or that the fire notification device properly produced its form of alert. The technicians would typically communicate via two-way radios or mobile phones to coordinate the testing of each device. In some cases, the technicians might even have resorted to comparing hand written notes of the tested devices. After a group of fire detection and fire annunciation devices was tested, the technician at the panel reset the control panel while the other technician moved to the next group of fire detection or fire annunciation devices.

More recently, it has been proposed to use connected services systems to monitor control panels during walkthrough tests, for example. In some cases, the control panels have been given network connectivity to communicate with the connected services systems; in other cases, the technicians have temporarily connected testing computers to the control panels that functioned as gateways. This has allowed the control panels to report status information to the connected services systems, which are typically administered by fire alarm system companies and include, for example, databases for storing historical status information. These connected services systems will also often have remote diagnostic capabilities. As such, connected services systems facilitate the maintenance, compliance and tracking of repairs of fire alarm systems.

SUMMARY OF THE INVENTION

Many installed fire alarm systems vary by age and manufacturer. As a result, many of the control panels are not compatible with the newer connected services system. Examples of non-compatible control panels include (older) legacy control panels and control panels manufactured by third parties. Legacy control panels often lack the network connectivity necessary to connect to a connected services system. Similarly, third party control panels lack network connectivity and/or use different protocols than the connected services system to communicate status information. As a result, connected services systems are unable to incorporate non-compatible control panels.

Systems have been proposed to provide network connectivity to non-compatible control panels, including retrofitting non-compatible control panels with gateway devices. However, access to legacy control panels to complete the installation is often difficult to achieve, and third party control panels are often incompatible with even the gateway devices. Additionally, because connected services systems are not required by regulations, the expense of retrofitting control panels of a fire alarm system is difficult to justify.

The monitoring stations, on the other hand, are often required by regulations. As a result, they are considered a standard component of fire alarm systems.

According to aspects of the invention, this near-universal connection between non-compatible control panels and monitoring stations can be used to transmit status information for non-compatible control panels to connected services systems. In this way, connected services systems can incorporate monitoring and tracking of non-compatible control panels as well as compatible control panels.

In general, according to one aspect, the invention features a method for monitoring fire alarm systems. As is common, compatible control panels send status, diagnostic and testing information directly to a connected services system and send fire alarm signals to monitoring stations. On the other hand, non-compatible control panels send fire alarm signals to the monitoring stations. The monitoring stations then forward status information to the connected services system for the non-compatible control panels. The connected services system will then map the status information from the non-compatible control panels to a connected services database system and store the status information from the compatible control panels to the same database system.

The non-compatible control panels include third party and legacy control panels. The non-compatible control panels send the fire alarm signals to the monitoring station possibly via several transmission media, including wide area networks, telephone systems, wireless radio networks, cellular networks, voice over internet protocol systems.

The monitoring station sends the status information for the non-compatible control panels to the connected services system via a wide area network, typically, and the status information is mapped to the connected services database via a mapping system, which can be a physically separate server or a process integrated with the standard system.

The status information can include identification, location, status history and alarm history.

Furthermore, in one embodiment, status, diagnostic and testing information can be detected by the connected services system from scanning printed reports, translated into compatible information by the mapping service and stored in the connected services database.

Further, the connected services server can retrieve histories of status, diagnostic and testing information and then send them to mobile computing devices. In this way, a technician using a mobile computing device activates fire detection and annunciation devices of a fire alarm system during a walkthrough test and view the status of the activated devices on the mobile computing device. The technician can then add annotations to the histories, and the mobile computing device sends annotated histories to the connected services server to be stored in the connected services database.

In general, according to another aspect, the invention features a connected services system for monitoring fire alarm systems. It comprises a connected services database for storing status, diagnostic and testing information from control panels of the fire alarm systems, a connected services server for receiving and storing the status information to the connected services database, and a mapping service for translating status information received from monitoring stations into compatible status information that is stored to the connected services database.

In general, according to another aspect, the invention features a method for testing a fire alarm system. In this method, a non-compatible control panel of a fire alarm system sends event data to a monitoring station. The monitoring station then forwards the event data to a connected services system, which stores the event data and passes the event data to a technician testing the control panel.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
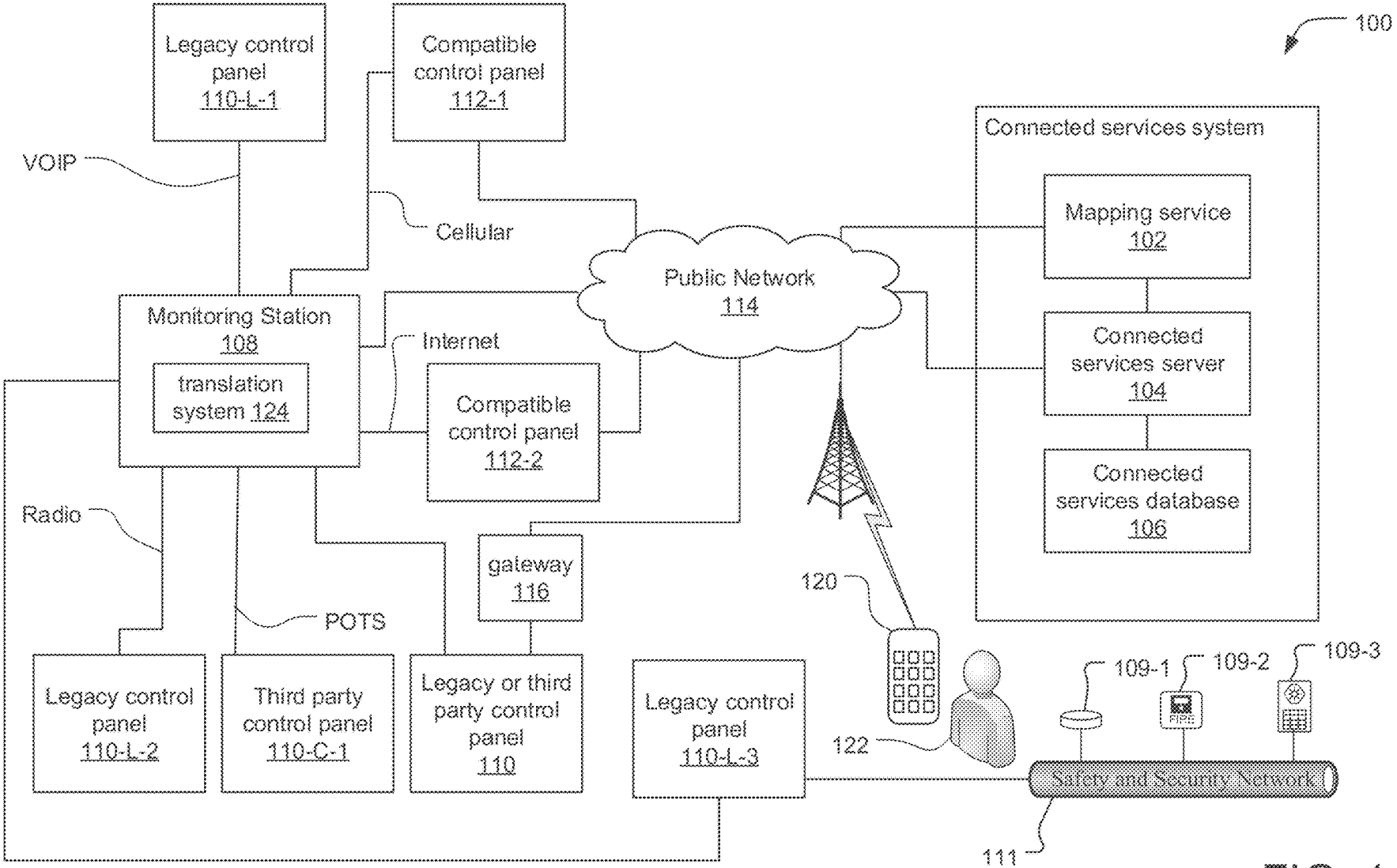
FIG. 1 is a block diagram of a connected services system monitoring fire alarms systems at least partially via one or more monitoring stations, according to the present invention.

FIG. 1 is a block diagram of a connected services system 100 according to the present invention.

In general, the connected services system 100 facilitates the monitoring, maintenance, testing, configuration and repair of fire alarm systems by gathering and storing information from connected fire alarm systems.

The connected services system 100 includes a connected services server 104 and a connected services database 106. The connected services server 104 receives information from various connected fire alarm systems typically via a public network 114, which is a wide area network such as the internet, and stores the information in the connected services database 106.

The connected services system 100 gathers data from fire alarm systems by receiving information reported and transmitted from the fire alarm systems' control panels 110, 112. Control panels 110, 112 are devices that direct the function of fire alarm systems by determining and displaying the operational status of connected fire detection and notification devices and by receiving alarm signals from fire detection devices, among other examples.

Each of the control panels 110, 112 will each support one or multiple loops or networks of fire detection and alarm notification devices. For clarity only a network of fire detection and alarm notification devices is shown, connected to the legacy control panel 110-L-3. Common examples of the fire detection devices 109-1, 109-2 typically include smoke detectors 109-1, carbon monoxide detectors, temperature sensors, and/or manual pull stations 109-2, to list a few examples. Similarly, examples of the fire alarm notification devices 109-3 generally include speakers/horns 109-3, bells/chimes, light emitting diode (LED) reader boards and/or flashing lights (e.g., strobes). In general, the fire detection and fire annunciation devices 109-1 to 109-3 connect to the control panels 110, 112 via a safety and security wired and/or wireless network 111 (also known as a loop), which supports data communication between the devices 109-1 to 109-3 and the control panels 110, 112.

The illustrated example includes compatible control panels 112, which transmit data to the connected services server 104 via the public network 114, usually through enterprise and/or cellular data networks. Data transmitted from compatible control panels 112 to the connected services server 104 include status information, diagnostic information and testing information pertaining to the control panel and other components of the fire alarm system such as fire detection and notification devices. Status information is information about whether the fire alarm system is operational and whether an alarm state is indicated. Generally, diagnostic information is data detected by various components of the fire alarm system that can be used to optimize or repair the system, and testing information is information about any tests of the fire alarm system. In some examples, diagnostic information includes identification information such as a unique identifier for the fire alarm control panel 110, address of the device or devices, location information such as a physical location of the devices (109-1, 109-2 . . . **109-*n***), a date and time of the activation, status information, including a fault state of the activated devices, analog and/or detected value generated by the devices such as a detected smoke level or detected ambient temperature.

Also illustrated are non-compatible control panels 110 such as legacy control panels 110-L and third party control panels 110-C. Legacy control panels 110-L are control panels that lack network connectivity and thus are unable to connect via the public network 114. Such control panels 110-L can be manufactured by the same company providing the connected services system 100 but at a time before network connectivity was desirable in control panels. Third party control panels 110-C are control panels manufactured by different companies or business entities than that providing the connected services system 100 and may or may not have network connectivity. Even if they have network connectivity, third party control panels 110-C will often use different protocols than the connected services system to communicate status, diagnostic and testing information.

Non-compatible control panels 110 can be retrofitted with devices that enable network connectivity. In the illustrated example, one non-compatible control panel 110 connects to a gateway device 116. The gateway device 116 provides access for the non-compatible control panel 110 to the public network 114 and thus to the connected services server 104.

However, regardless of age or manufacturer, control panels will almost universally communicate with a monitoring station 108, which is a service for monitoring multiple fire alarm systems for indications of a potential fire and notifying the proper authorities, such as the fire department. Monitoring stations 108 can be administered by a third party company, the same company that manufactured the fire alarm system, the same company providing the connected services system 100, or a public agency, among other examples. They are often required by regulations, making them a standard component of most fire alarm systems.

According to the present invention, instead of sending information directly to the connected services server 104, the non-compatible control panels 110 send connection status signals and alarm signals to the monitoring station 108. Connection status signals are signals that will typically employ a handshaking arrangement to confirm the connection between the control panels 110, 112 and the monitoring station 108 is active and functionality properly. Alarm signals are signals indicating that a fire alarm system has entered an alarm state, indicating a potential fire.

In different examples, the non-compatible control panels 110 will send signals to the monitoring station 108 via several different transmission media, including wide area networks such as the internet, telephone systems, wireless radio networks, cellular networks and voice over internet protocol (VOIP) systems.

The monitoring station 108 receives the connection status and alarm signals from the non-compatible control panels 110 and forwards status information for the non-compatible control panels 110 to the connected services system 100 via the public network 114.

In one embodiment, the status information is translated by a translation system 124. This translation system can be a process that executes on the computer system of the monitoring station 108 or executes on a separate monitoring station gateway computer system. In either case, the translation system 124 translates status information into a compatible format before it is sent to the connected services system 100.

In another embodiment, status information from the monitoring station 108 is received by a mapping service 102. This mapping service can be a mapping server or mapping process executing on a connected services server 104 of the connected services system 100. The mapping service 102 is a process that translates status information received from the monitoring station 108 into compatible status information that is stored to the connected services database 106.

Also shown is an on-site technician 122 using a mobile computing device 120. In general, the technicians will perform maintenance, testing and repair on the different fire alarm systems. The mobile computing device 120 connects to the public network 114 over a wireless communication link and operated by the technician 122. In examples, the mobile computing device 120 is a laptop computer, smart phone, tablet computer, or phablet computer (i.e., a mobile device that is typically larger than a smart phone, but smaller than a tablet), to list a few. The mobile computing device 120 receives and displays status, diagnostic and testing information from the connected services server 104 via the public network 114.

Figure 2:
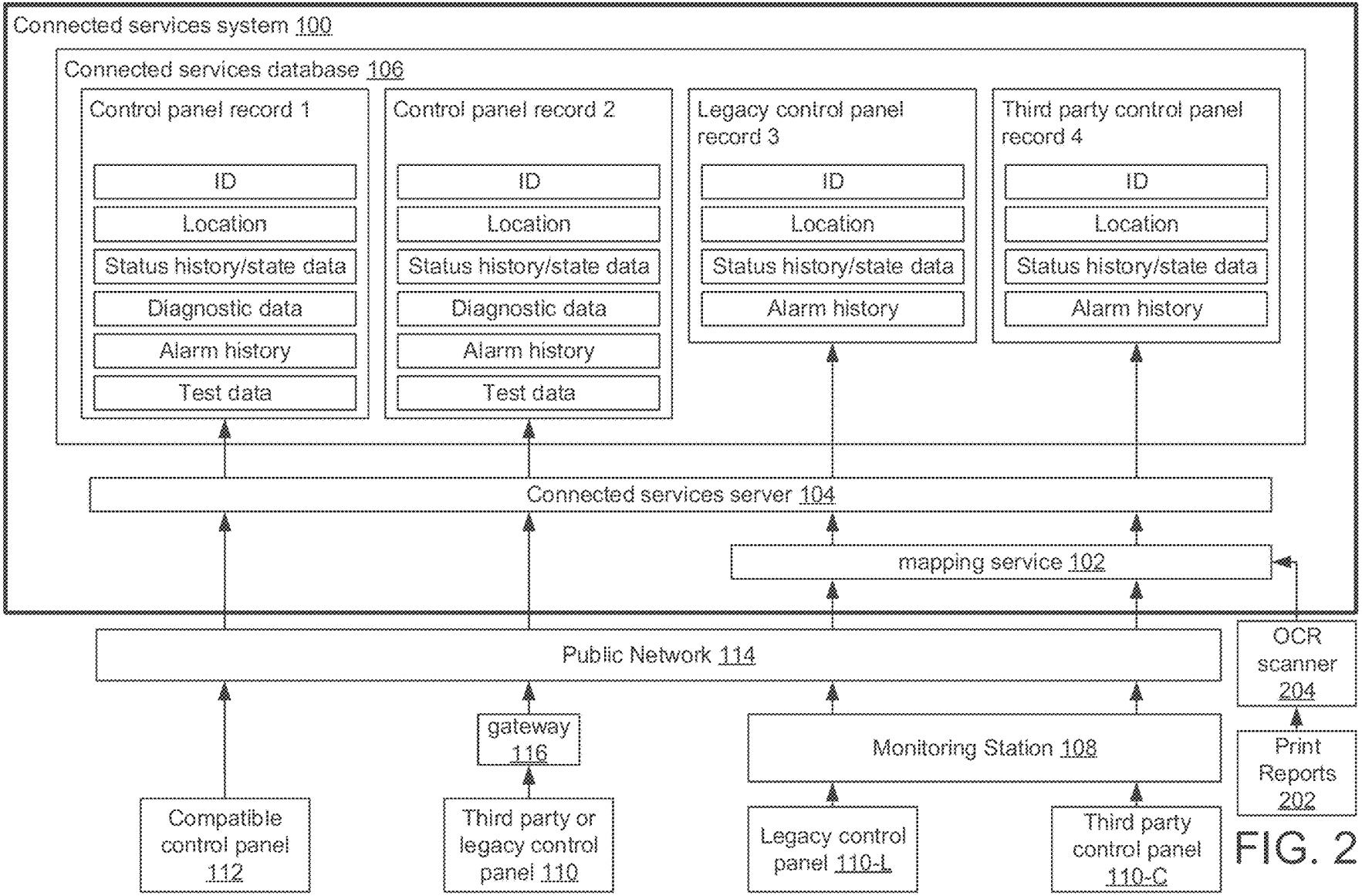
FIG. 2 illustrates an example of information being stored in a connected services database of the connected services system.

FIG. 2 illustrates an example of information being stored in the connected services database 106 of the connected services system 100.

In one example, a compatible control panel 112 sends status, diagnostic and testing information directly to the connected services server 104 via the public network 114. The connected services server 104 stores the information in the connected services database 106. The information is stored in "Control panel record 1", which includes identification information, location information, status history/state data, diagnostic data, alarm history and test data pertaining to the fire alarm system that includes the compatible control panel 112.

Identification information can include a user specified name or serial number, among other examples. Location information can include an address of the premises in which the fire alarm system is installed as well as specific locations within the premises where the compatible control panel 112, or other fire detection and notification devices are installed. Status history/state data can include the operational status of the fire alarm system and its components over time. Diagnostic information can include the power status (such as line voltage, battery voltage, and whether the device is powered by the battery or the line), sensor data (such readings from the sensors of various individual fire detection devices), and loop status, among other examples. Testing information can include the time and date of tests performed on the fire alarm system, the pass/fail result of the tests, and the readings detected by components of the fire alarm system during testing, among other examples.

In another example, one or more non-compatible control panel 110 sends status, diagnostic and testing information to the connected services server 104 via the gateway device 116, which allows connectivity to the public network 114. The connected services server 104 stores the information in the connected services database 106. The information is stored in "Control panel record 2", which includes the same types of information described for "Control panel record 1" pertaining to the fire alarm system that includes the non-compatible control panel 110.

On the other hand, a legacy control panel 110-L sends connection status and alarm signals to the monitoring station 108. The monitoring station 108 then forwards status information for the legacy control panel 110-L to the mapping service or server 102 via the public network 114. The mapping service 102 translates the status information into a compatible format and forwards it to the connected services server 104. The connected services server 104 then stores the information in the connected services database 106. The information is stored in "Control panel record 3", which includes identification information, location information, status history/state data, alarm history and test data pertaining to the fire alarm system that includes the legacy control panel 110-L.

In another example, a third party control panel 110-C sends connection status and alarm signals to the monitoring station 108. The monitoring station 108 then forwards status information for the third party control panel 110-C to the mapping service 102 via the public network 114. The mapping service 102 translates the status information into a compatible format and forwards it to the connected services server 104. The connected services server 104 stores the information in the connected services database 106. The information is stored in "Control panel record 4", which includes identification information, location information, status history/state data, alarm history and test data pertaining to the fire alarm system that includes the legacy control panel 110-C.

Also illustrated in this example are print reports 202, which are reports printed on paper that can include status, diagnostic and testing information pertaining to fire alarm systems. This information is detected and extracted from the print reports 202, for example, by a scanner 204 in conjunction with software with optical character recognition capabilities. The mapping service 102 receives the information from the printed reports 202 via the OCR scanner 204 and translates it into a compatible format. The information is then stored in the connected services database 106 in the appropriate control panel records.

In one example, a university includes several buildings with several fire alarm systems, which include components that vary by age and manufacturer, including compatible control panels 112 and/or non-compatible control panels 110. A technician 122 testing or repairing the fire alarm systems for the university can use the connected services system 100 to generate a comprehensive inventory of control panels for the entire university, regardless of compatibility between the control panels and the connected services system 100. The inventory is requested with, received by, and displayed on the mobile computing device 120.

In another example, a fire alarm system including a non-compatible control panel 110 is operating normally. Connection status signals are sent from the control panel 110 to the monitoring station 108. The monitoring station 108 forwards status information to the connected services system 100. The information is mapped by the mapping service 102 and stored in the connected services database 106. A technician 122 views the control panel record for the fire alarm system on the mobile computing device 120 and confirms that the connection between the fire alarm system and the monitoring station 108 is consistently strong.

In another example, a fire alarm system including a non-compatible control panel 110 intermittently loses connectivity with the monitoring station 108. A technician 122 reviews and analyzes the status history of the non-compatible control panel 110 on the mobile computing device 120 to determine possible causes of the loss of connectivity such as recurring network congestion or a periodic walkthrough tests of the fire alarm system, causing the fire alarm system to be disconnected from the monitoring station 108.

The above described systems can also be used to facilitate, monitor and validate walkthrough tests. The following describes a conventional walkthrough test using a connected services system and then a test in which the panel is connected to the connected services system via a monitoring station.

Figure 3A:
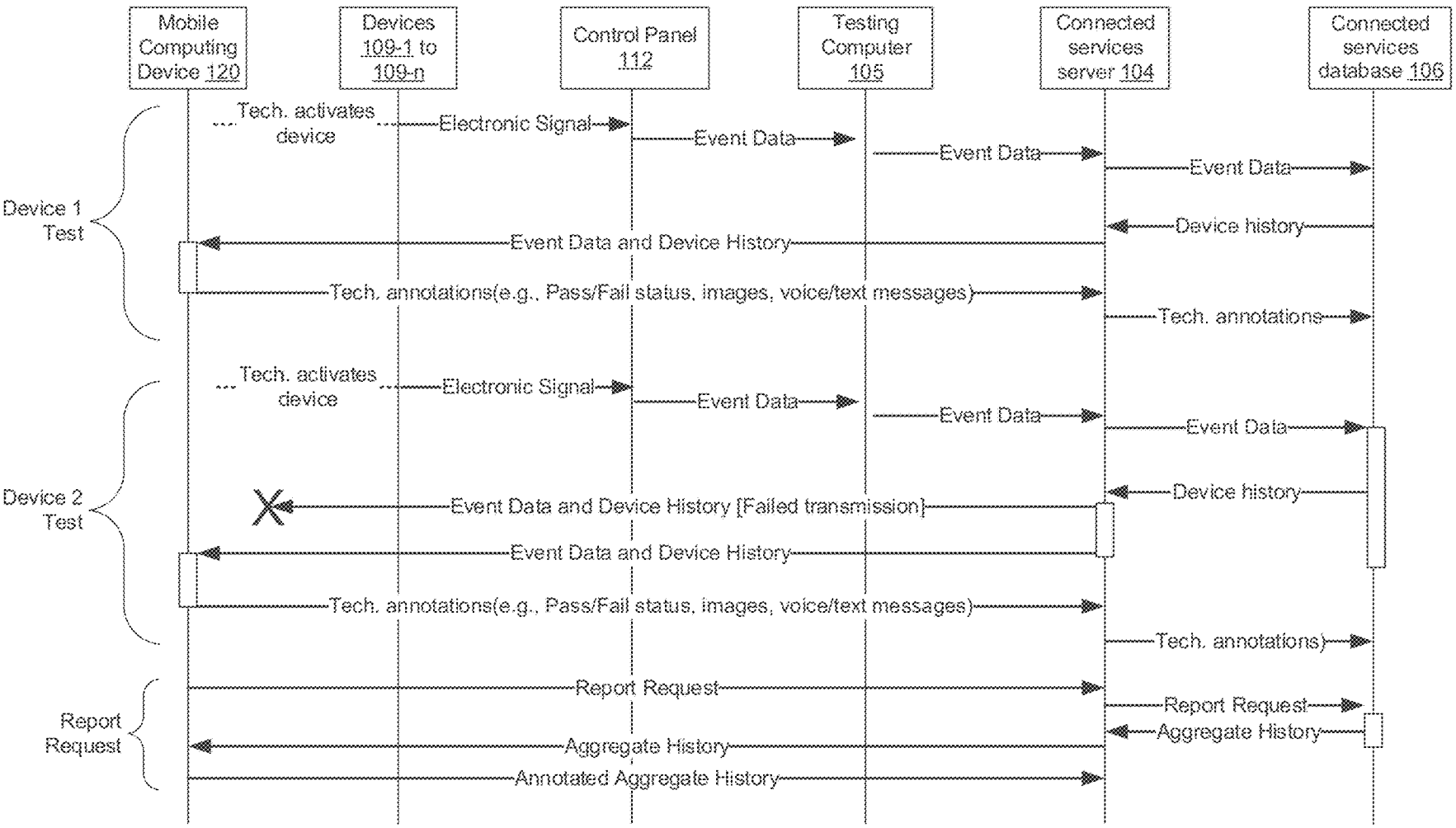
FIG. 3A is a sequence diagram illustrating how a mobile computing device, fire detection and fire annunciation devices, a control panel, a testing computer, a connected services server interact during a walkthrough test in a conventional setup.

In more detail, FIG. 3A is a sequence diagram illustrating how the mobile computing device 120, fire detection and fire annunciation devices 109-1 to 109-3, control panel 112, a testing computer 105, connected services server 104, and connected services database 106 interact during a walkthrough test in a conventional setup.

This method is disclosed in an earlier application entitled "Testing System and Method for Fire Alarm System" by Anthony P. Moffa (U.S. Pat. Appl. Publ. No. US 2015/0206421), which is incorporated herein by this reference.

In this setup, the testing computer 105 is connected to the control panel 110 (with an RS-232 cable, a universal serial bus (USB) cable or Ethernet (IEEE 802.3) cable (e.g., Cat 5 or Cat 6), to list a few examples). The testing computer 105 also connects to the public network 114.

In a first example (labeled Device 1 Test), the on-site technician 122 activates one of the fire detection and fire annunciation devices 109-1 to 109-3 of the fire alarm system. The activated device sends an electronic signal to the control panel 110. This electronic signal could be a binary signal indicating an alarm state and/or what is termed an analog value, which is representation of the level of smoke detected (obscuration level) by the device.

The control panel generates event data, which are sent to the testing computer 105. The event data are then sent from the testing computer 105 to the connected services server 104, which stores the event data in the connected service database 106. The connected services server 104 then sends the event data and device history data to the mobile computing device 120.

Typically, the event data includes identification information such as a unique identifier for the fire alarm control panel 110, 112, address of the activated device or devices generating the event data, location information such as a physical location of the activated devices (109-1, 109-2 . . . **109-*n***), a date and time of the activation, status information, including a fault state of the activated devices, at least one analog and/or detected value generated by the activated devices such as a detected smoke level or detected ambient temperature, and/or custom labels of the activated devices. Additionally, acknowledgement and restoral times of the control panel are included in the event data.

In the illustrated example, the on-site technician 122 reviews the event data and optionally applies annotations to the event data. These annotations typically include testing information such as a pass or fail status, images, and/or voice and text messages, to list a few examples. For example, if the fire detection or fire annunciation device appears worn or damaged, the technician would annotate the event data with an image of the device. The annotated event data are then sent back to the connected services server 104 and stored in the connected services database 106. This annotated device history may be accessed later by the on-site technician 122, a remote technician, or other users that are authorized to access the event data.

A second example (labeled Device 2 Test) illustrates a scenario in which the mobile computing device 120 temporarily loses communication with the connected services server 104. In general, the testing process is similar to the previous example (i.e., Device Test 1). In this example, however, the mobile computing device 120 temporarily loses communication with the connected services server 104. Because communication has been lost, the transmission of event data from connected services server 104 fails to reach the mobile computing device 110. In the illustrated example, this is shown by the "X." In a current implementation, if there is a failed transmission, the connected services server 104 buffers and attempts to resend the event data. This event data could be resent based on a request from the mobile computing device 120 or the connected services server 104 could attempt resend the event periodically until event data are received and acknowledged by the mobile computing device 120.

The sequence diagram further illustrates a report request from the on-site technician 122 (labeled Report Request). Typically, reports are generated after the on-site technician 122 has completed the test of the entire fire alarm system, but the on-site technician 122 (or a remote technician) could request a report at any time before or during the test.

In the illustrated embodiment, the on-site technician 122 sends a report request to the connected services server 104. The connected services server 104 queries the connected services database 106 to obtain an aggregate history for all of the fire detection and fire annunciation devices of the fire alarm system. The aggregate history data are transferred to the mobile computing device 120 and reviewed by the on-site technician 122. The on-site technician 122 may then add annotations to the aggregate history data and send the annotated aggregate history data to connected services server 104.

Figure 3B:
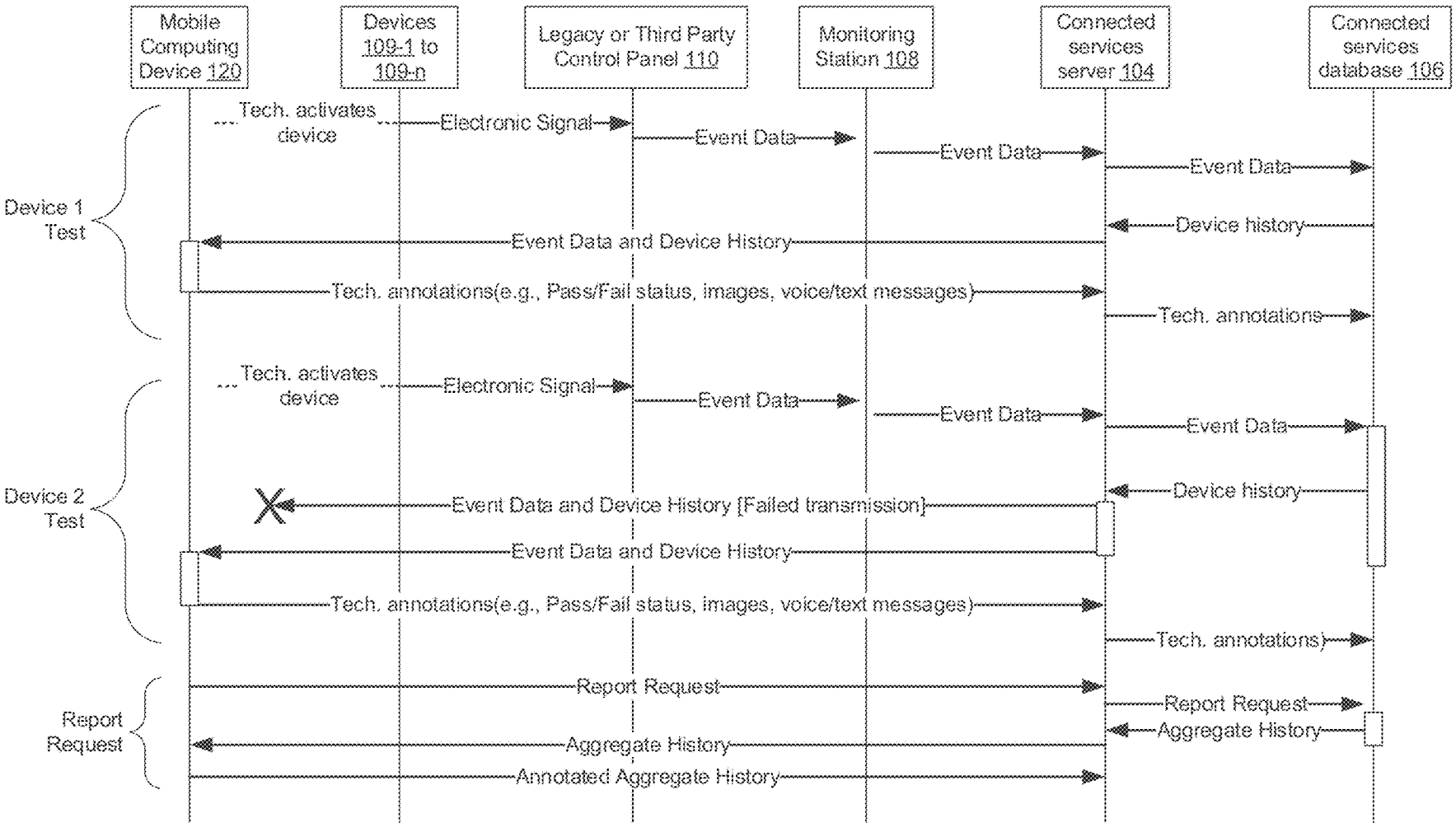
FIG. 3B is a sequence diagram illustrating how the mobile computing device, fire detection and fire annunciation devices, control panel, monitoring station and the connected services server interact during a walkthrough test according to embodiments of the invention.

FIG. 3B is a sequence diagram illustrating how the monitoring station 108 can be used to communicate status information and/or event data from legacy or third party control panels 110 to the connected services server 104 during a walkthrough test of a fire alarm system.

In a first example (labeled Device 1 Test), the on-site technician 122 activates one of the fire detection and fire annunciation devices 109-1 to **109-*n*** of the fire alarm system. This can be accomplished by depressing a self-test button on the housing of the device or by placing a hood over a smoke detector, for example, and filling the hood with real or artificial smoke.

As before, the activated device sends an electronic signal to the control panel 110. This electronic signal could be a binary signal indicating an alarm state and/or what is termed an analog value, which is representation of the level of smoke detected (obscuration level) by the device.

The control panel 110 generates event data, which are sent to the monitoring station 108 via the POTS, VOIP, Cellular or other data connection. The event data are then sent from the monitoring station 108 to the connected services system 100, which stores the event data in the connected service database 106. Here, the event data includes identification information such as a unique identifier for the fire alarm control panel 110, address of the activated device or devices generating the event data, location information such as a physical location of the activated devices (109-1, 109-2 . . . **109-*n***), a date and time of the activation, status information, including a fault state of the activated devices, at least one analog and/or detected value generated and transmitted by the activated devices such as a detected smoke level or detected ambient temperature, and/or custom labels of the activated devices. Additionally, acknowledgement and restoral times of the control panel and/or tested devices are included in the event data.

In some examples, the translation system 124 in the monitoring station 108 is used to translate the event data into a format expected by the connected services server 104. In other examples, this translation is performed by the mapping service 102.

In any event, the connected services server 104 then sends the event data and device history data (including identification information, location information, status history/state data, diagnostic data, alarm history and test data) to the mobile computing device 120.

As before, the on-site technician 122 reviews the event data and optionally applies annotations to the event data. These annotations typically include a pass or fail status, images, and/or voice and text messages, to list a few examples. For example, if the fire detection or fire annunciation device appears worn or damaged, the technician would annotate the event data with an image of the device. The annotated event data are then sent back to the connected services server 104 and stored in the connected services database 106. This annotated device history may be accessed later by the on-site technician 122, a remote technician, or other users that are authorized to access the event data.

The sequence diagram further illustrates the report request from the on-site technician 122 (labeled Report Request).

Typically, reports are generated after the on-site technician 122 has completed the test of the entire fire alarm system, but the on-site technician 122 (or a remote technician) could request a report at any time before or during the test.

In the illustrated embodiment, the on-site technician 122 sends a report request to the connected services server 104. The connected services server 104 queries the connected services database 106 to obtain an aggregate history for all of the fire detection and fire annunciation devices of the fire alarm system. The aggregate history data are transferred to the mobile computing device 120 and reviewed by the on-site technician 122. The on-site technician 122 may then add annotations to the aggregate history data and send the annotated aggregate history data to connected services server 104 as before.

One advantage of the present system is that this automated inspection feature is the proof of inspection created by connected service system 100, including time stamping and coverage of testing despite the fact that the inspection is being performed on a legacy control panel 110-L, for example. As a result, testing validation is now possible on existing panels 110, which only have a connection to a monitoring station 108.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for testing a fire alarm system, the method comprising:

a non-compatible control panel of a fire alarm system sending event data to a monitoring station, wherein the monitoring station monitors multiple fire alarm systems for indications of a alarm triggering event;

the monitoring station forwarding the event data to a connected services system; and the connected services system storing the event data and also passing the event data to a technician for testing the control panel remotely from connected service system, wherein the non-compatible control panel is not direct connect to the connected services system and support one or multiple loops or networks of fire detection and alarm notification devices, and the monitoring station notifies authorities in response to receiving alarm signals from the non-compatible control panels.

2. The method according to claim 1, wherein the connected services system passes the event data to a mobile computing device of the technician testing the control panel.

3. The method according to claim 1, further comprising the connected services system mapping status diagnostic and testing information for the non-compatible control panels to a connected services database of the connected services system and storing the status, diagnostic and testing information for the compatible control panels to the connected services database.

4. The method according to claim 3, wherein the status information for non-compatible control panel is mapped to the connected services database via a mapping service.

5. The method according to claim 1, wherein the event data includes identification information including a unique identifier for the control panel.

6. The method according to claim 1, wherein the event data includes an address of an activated device or devices generating the event data.

7. The method according to claim 1, wherein the event data includes at least one analog and/or detected value generated by activated devices.

8. The method according to claim 1, wherein the technician reviews the event data and optionally applies annotations to the event data via a mobile computing device.

9. The method according to claim 1, wherein the technician views a control panel record for control panel of the fire alarm system on the mobile computing device and confirms that the connection between the fire alarm system and the monitoring station is consistently strong.

10. The method according to claim 1, wherein the mobile computing device provides status history of the non-compatible control panel to determine possible causes of the loss of connectivity such as recurring network congestion or a periodic walkthrough tests of the fire alarm system, causing the fire alarm system to be disconnected from the monitoring station.

11. A system for testing a fire alarm system, comprising: a non-compatible control panel of a fire alarm system that sends event data; a monitoring station that receives the event data and forwards the event data, wherein the monitoring station monitors multiple fire alarm systems for indications of a alarm triggering event; and a connected services system for receiving the event data forwarded from the monitoring station and storing the event data and also passing the event data to a technician for testing the control panel remotely from connected service system, wherein the non-compatible control panel is not connect to the connected services system and support one or more loops or networks of fire detection and alarm notification devices, and the monitoring station notifies authorities in response to receiving alarm signals from the non-compatible control panels.

12. The system according to claim 11, wherein the connected services system passes the event data to a mobile computing device of the technician testing the control panel.

13. The system according to claim 11, further comprising the connected services system mapping status diagnostic and testing information for the non-compatible control panels to a connected services database of the connected services system and storing the status, diagnostic and testing information for the compatible control panels to the connected services database.

14. The system according to claim 13, wherein the status information for non-compatible control panel is mapped to the connected services database via a mapping service.

15. The system according to claim 11, wherein the event data includes identification information including a unique identifier for the control panel.

16. The system according to claim 11, wherein the event data includes an address of an activated device or devices generating the event data.

17. The system according to claim 11, wherein the event data includes at least one analog and/or detected value generated by activated devices.

18. The system according to claim 11, wherein the technician reviews the event data and optionally applies annotations to the event data via a mobile computing device.

19. The system according to claim 11, wherein the technician views a control panel record for control panel of the fire alarm system on the mobile computing device and confirms that the connection between the fire alarm system and the monitoring station is consistently strong.

20. The system according to claim 11, wherein the mobile computing device provides status history of the non-compatible control panel to determine possible causes of the loss of connectivity such as recurring network congestion or a periodic walkthrough tests of the fire alarm system, causing the fire alarm system to be disconnected from the monitoring station.

* * * * *